US011495156B2

(12) United States Patent
Mei et al.

(10) Patent No.: US 11,495,156 B2
(45) Date of Patent: Nov. 8, 2022

(54) DISPLAY DEVICE

(71) Applicant: Shenzhen China Star Optoelectronics Semiconductor Display Technology Co., Ltd., Guangdong (CN)

(72) Inventors: Wenlin Mei, Guangdong (CN); Xingyi Liu, Guangdong (CN); Sikun Hao, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 121 days.

(21) Appl. No.: 17/051,243

(22) PCT Filed: May 15, 2020

(86) PCT No.: PCT/CN2020/090487
§ 371 (c)(1),
(2) Date: Oct. 28, 2020

(87) PCT Pub. No.: WO2021/217735
PCT Pub. Date: Nov. 4, 2021

(65) Prior Publication Data

US 2022/0189360 A1 Jun. 16, 2022

(30) Foreign Application Priority Data

Apr. 30, 2020 (CN) ..... 202010360455.X

(51) Int. Cl.
*G09G 3/20* (2006.01)

(52) U.S. Cl.
CPC ..... *G09G 3/20* (2013.01); *G09G 2310/0267* (2013.01); *G09G 2320/0233* (2013.01)

(58) Field of Classification Search
CPC ... G09G 2320/0233; G09G 2310/0267; G09G 3/20
See application file for complete search history.

(56) References Cited

U.S. PATENT DOCUMENTS

2008/0001906 A1* 1/2008 Wang ..... G09G 3/342 345/102
2009/0140976 A1 6/2009 Bae et al.
2010/0123652 A1 5/2010 Chen et al.
2015/0054818 A1 2/2015 Cho et al.
(Continued)

FOREIGN PATENT DOCUMENTS

CN 101447156 A 6/2009
CN 100587570 C 2/2010
(Continued)

*Primary Examiner* — Gerald Johnson
(74) *Attorney, Agent, or Firm* — Mark M. Friedman

(57) ABSTRACT

A display device is disclosed. The display device includes a display panel and a driving chip. The display panel includes at least a first display area and a second display area arranged side by side along a first direction. In the present application, by controlling any two adjacent display areas to scan toward each other or to scan away from each other, at least one scanning lines in the first display area and at least one scanning lines in the second display area simultaneously receive driving signals input from the driving chip.

16 Claims, 5 Drawing Sheets

(56) References Cited

U.S. PATENT DOCUMENTS

| | | | |
|---|---|---|---|
| 2016/0019824 | A1 | 1/2016 | Choi et al. |
| 2019/0164994 | A1 | 5/2019 | Gan |

FOREIGN PATENT DOCUMENTS

| | | | |
|---|---|---|---|
| CN | 105161059 | A | 12/2015 |
| CN | 107765487 | A | 3/2018 |
| CN | 107797354 | A | 3/2018 |
| CN | 109003584 | A | 12/2018 |
| CN | 109637482 | A | 4/2019 |
| CN | 110060652 | A | 7/2019 |
| CN | 110931542 | A | 3/2020 |

* cited by examiner

DISPLAY DEVICE

FIELD OF INVENTION

The present application relates to the field of display technologies, and more particularly, to a display device.

BACKGROUND OF INVENTION

With the development of big screen TVs, the requirement for screen definition is getting higher and higher, and 8K or higher resolution display panels will definitely become a development trend.

As panel sizes increase, the large display panel includes more pixels and more scanning lines. Since the time for the display panel to display one frame is fixed, the charging time assigned to any scanning line decreases. In addition, since general signal lines have a certain impedance, the influence of the resistance and capacitance of the panel on the signal delay increases as being away from a signal emitting end. Thus, when the above two factors are combined, the current panel driving methods cannot achieve the increased panel size or panel resolution.

In summary, a display device is urgently needed to solve the above technical problems.

SUMMARY OF INVENTION

Technical Problems

The present application provides a display device to solve the technical problem that the current driving methods of the display device cannot achieve the increased product size or/product resolution.

Technical Solutions

The present application provides a display device, comprising: a display panel and a driving chip, the display panel including at least a first display area and a second display area arranged side by side along a first direction, the driving chip being configured to drive the first display area and the second display area to display, and to control the first display area and the second display area to scan toward each other or to scan away from each other;

wherein, at least one scanning line in the first display area and at least one scanning line in the second display area simultaneously receive driving signals input from the driving chip.

In the display device of the present application, a scanning direction of the first display area is the same as the first direction, and a scanning direction of the second display area is opposite to the first direction.

wherein, the first direction is parallel to a data line of the display panel.

In the display device of the present application, the display panel includes 2k scanning lines, the $1^{st}$ to $k^{th}$ scanning lines are located in the first display area, and the $(k+1)^{th}$ to $(2k)^{th}$ scanning lines are located in the second display area; and the scanning direction of the first display area is the $1^{st}$ to $k^{th}$ scanning lines, and the scanning direction of the second display area is the $(2k)^{th}$ to $(k+1)^{th}$ scanning lines, wherein the k is a positive integer.

In the display device of the present application, the driving chip includes 2k output channels, and one of the output channels is correspondingly connected to one of the scanning lines;

wherein the output channel in a first driving area in the driving chip is correspondingly connected to the scanning line in the first display area, and the output channel in a second driving area in the driving chip is correspondingly connected to the scanning line in the second display area.

In the display device of the present application, the first driving area is the $1^{st}$ to $(2k-1)^{th}$ output channels which are the odd-numbered items in the driving chip, and the second driving area is the $2^{nd}$ to $(2k)^{th}$ output channels which are the even-numbered items in the driving chip; and the $1^{st}$ to $k^{th}$ scanning lines in the first display area are sequentially connected to the $1^{st}$ to $(2k-1)^{th}$ output channels in the first driving area, and the $(2k)^{th}$ to $(k+1)^{th}$ scanning lines in the second display area are sequentially connected to the $2^{nd}$ to $(2k)^{th}$ output channels in the second driving area;

wherein the $(2k-1)^{th}$ and $(2k)^{th}$ output channels simultaneously input driving signals to the corresponding scanning lines.

In the display device of the present application, the driving chip includes k output terminals, and one of the output terminals includes two of the output channels;

wherein the $(2k-1)^{th}$ output channel in the first driving area and the $(2k)^{th}$ output channel in the second driving area are electrically connected to the $k^{th}$ output terminal in the driving chip.

In the display device of the present application, the first driving area is the $1^{st}$ to $k^{th}$ output channels in the driving chip, and the second driving area is the $(k+1)^{th}$ to the $(2k)^{th}$ output channels in the driving chip;

the $1^{st}$ to $k^{th}$ scanning lines in the first display area are electrically connected to the $1^{st}$ to $k^{th}$ output channels in the first driving area in sequence, and the $(k+1)^{th}$ to $(2k)^{th}$ scanning lines in the second display area are electrically connected to the $(k+1)^{th}$ to $(2k)^{th}$ output channels in the second driving area in sequence; and the display device outputs a first scanning signal to the $1^{st}$ to $k^{th}$ output channels, and simultaneously outputs a second scanning signal to the $(2k)^{th}$ to $(k+1)^{th}$ output channels.

In the display device of the present application, the driving chip includes at least a first driver and a second driver, the first driver is configured to drive the first display area to display, and the second driver is configured to drive the second display area to display;

wherein the first driver includes k first output channels arranged along a first direction, the second display area includes k second output channels arranged along a second direction, and one of the scanning lines is correspondingly connected to one of the first output channels or one of the second output channels;

wherein the $1^{st}$ to $k^{th}$ scanning lines in the first display area are electrically connected to the $1^{st}$ to $k^{th}$ first output channels in the first driver in sequence, and the $(2k)^{th}$ to $(k+1)^{th}$ scanning lines in the second display area are electrically connected to the $1^{st}$ to $k^{th}$ second output channels in the second driver in sequence.

In the display device of the present application, the $n^{th}$ scanning line in the first display area and the $(2k+1-n)^{th}$ scanning line in the second display area simultaneously receive scanning signals input from the corresponding output channels, $1 \le n \le k$, and n is a positive integer.

In the display device of the present application, the display panel further includes a third display area located on one side of the second display area and away from the first display area;

wherein a scanning direction of the third display area is the same as the scanning direction of the first display area.

The present application further provides a display device, comprising a display panel and a driving chip, the display panel including at least a first display area and a second display area arranged side by side along a first direction, the driving chip being configured to drive the first display area and the second display area to display, and to control the first display area and the second display area to scan toward each other or to scan away from each other, wherein the first direction is parallel to a data line of the display panel;

wherein, at least one scanning line in the first display area and at least one scanning line in the second display area simultaneously receive driving signals input from the driving chip.

In the display device of the present application, a scanning direction of the first display area is the same as the first direction, and a scanning direction of the second display area is opposite to the first direction.

In the display device of the present application, the display panel includes 2k scanning lines, the $1^{st}$ to $k^{th}$ scanning lines are located in the first display area, and the $(k+1)^{th}$ to $(2k)^{th}$ scanning lines are located in the second display area; and the scanning direction of the first display area is the $1^{st}$ to $k^{th}$ scanning lines, and the scanning direction of the second display area is the $(2k)^{th}$ to $(k+1)^{th}$ scanning lines, wherein the k is a positive integer.

In the display device of the present application, the driving chip includes 2k output channels, and one of the output channels is correspondingly connected to one of the scanning lines;

wherein the output channel in a first driving area in the driving chip is correspondingly connected to the scanning line in the first display area, and the output channel in a second driving area in the driving chip is correspondingly connected to the scanning line in the second display area.

In the display device of the present application, the first driving area is the $1^{st}$ to $(2k-1)^{th}$ output channels which are the odd-numbered items in the driving chip, and the second driving area is the $2^{nd}$ to $(2k)^{th}$ output channels which are the even-numbered items in the driving chip; and the $1^{st}$ to $k^{th}$ scanning lines in the first display area are sequentially connected to the $1^{st}$ to $(2k-1)^{th}$ output channels in the first driving area, and the $(2k)^{th}$ to $(k+1)^{th}$ scanning lines in the second display area are sequentially connected to the $2^{nd}$ to $(2k)^{th}$ output channels in the second driving area;

wherein the $(2k-1)^{th}$ and $(2k)^{th}$ output channels simultaneously input driving signals to the corresponding scanning lines.

In the display device of the present application, the driving chip includes k output terminals, and one of the output terminals includes two of the output channels;

wherein the $(2k-1)^{th}$ output channel in the first driving area and the $(2k)^{th}$ output channel in the second driving area are electrically connected to the $k^{th}$ output terminal in the driving chip.

In the display device of the present application, the first driving area is the $1^{st}$ to $k^{th}$ output channels in the driving chip, and the second driving area is the $(k+1)^{th}$ to the $(2k)^{th}$ output channels in the driving chip;

the $1^{st}$ to $k^{th}$ scanning lines in the first display area are electrically connected to the $1^{st}$ to $k^{th}$ output channels in the first driving area in sequence, and the $(k+1)^{th}$ to $(2k)^{th}$ scanning lines in the second display area are electrically connected to the $(k+1)^{th}$ to $(2k)^{th}$ output channels in the second driving area in sequence; and the display device outputs a first scanning signal to the $1^{st}$ to $k^{th}$ output channels, and simultaneously outputs a second scanning signal to the $(2k)^{th}$ to $(k+1)^{th}$ output channels.

In the display device of the present application, the driving chip includes at least a first driver and a second driver, the first driver is configured to drive the first display area to display, and the second driver is configured to drive the second display area to display;

wherein the first driver includes k first output channels arranged along a first direction, the second display area includes k second output channels arranged along a second direction, and one of the scanning lines is correspondingly connected to one of the first output channels or one of the second output channels;

wherein the $1^{st}$ to $k^{th}$ scanning lines in the first display area are electrically connected to the $1^{st}$ to $k^{th}$ first output channels in the first driver in sequence, and the $(2k)^{th}$ to $(k+1)^{th}$ scanning lines in the second display area are electrically connected to the $1^{st}$ to $k^{th}$ second output channels in the second driver in sequence.

In the display device of the present application, the $n^{th}$ scanning line in the first display area and the $(2k+1-n)^{th}$ scanning line in the second display area simultaneously receive scanning signals input from the corresponding output channels, $1 \le n \le k$, and n is a positive integer.

In the display device of the present application, the display panel further includes a third display area located on one side of the second display area and away from the first display area;

wherein a scanning direction of the third display area is the same as the scanning direction of the first display area.

Beneficial Effect

In the present application, by controlling any two adjacent display areas to scan toward each other or to scan away from each other, at least one scanning line in the first display area and at least one scanning line in the second display area simultaneously receive driving signals input from the driving chip, thereby improving the uniformity of the display panel. In addition, the plurality of display areas scanning at the same time increases the charging time of any scanning line, so that the size and the resolution of the display device can be improved.

DETAILED DESCRIPTION OF PREFERRED EMBODIMENTS

Figure 1:
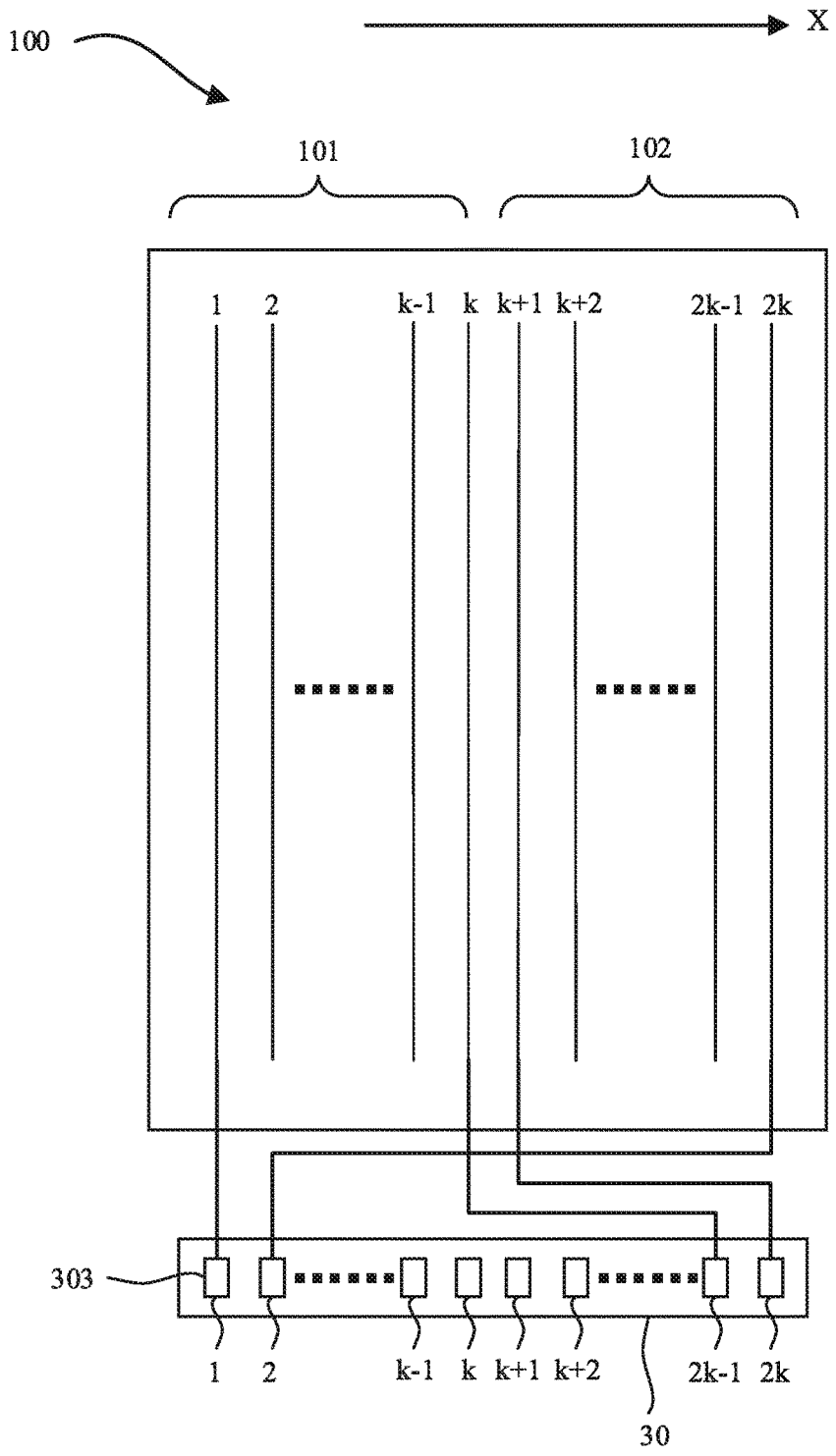
FIG. 1 is a first structural diagram of a display device of the present application.

In order to make the purposes, technical solutions and effects of the present application clear and definite, the present application will be described in further detail below with reference to the accompanying drawings and embodiments. It should be understood that the specific embodiments described herein are only used to explain the present application, and are not used to limit the present application.

As panel sizes increase, the large display panel includes more pixels and more scanning lines. Since the time for the display panel to display one frame is fixed, the charging time assigned to any scanning line decreases. In addition, since general signal lines have a certain impedance, the influence of the resistance and capacitance of the panel on the signal delay increases as being away from a signal emitting end. Thus, the current panel driving methods cannot achieve the increased panel size or panel resolution. The present application proposes a display device based on the above technical problems. The specific solution is as follows.

Refer to FIGS. 1-5. The display device comprises a display panel 100 and a driving chip 30. The display panel 100 includes at least a first display area 101 and a second display area 102 arranged side by side along a first direction X. The driving chip 30 is configured to drive the first display area 101 and the second display area 102 to display, and to control the first display 101 area and the second display area 102 to scan toward each other or to scan away from each other.

At least one scanning line in the first display area 101 and at least one scanning line in the second display area 102 simultaneously receive driving signals input from the driving chip 30.

In the present application, by controlling any two adjacent display areas to scan toward each other or to scan away from each other, at least one scanning line in the first display area 101 and at least one scanning line in the second display area 102 simultaneously receive driving signals input from the driving chip 30, thereby improving the uniformity of the display panel. In addition, the plurality of display areas scanning at the same time increases the charging time of any scanning line, so that the size and the resolution of the display device 100 can be improved.

The technical solutions of the present application will now be described in combination with specific embodiments.

In the display device of the present application, the display panel 100 includes at least the first display area 101 and the second display area 102 arranged side by side along the first direction X. The display panel 100 of the present application may include a plurality of display areas in different scanning directions. In the present embodiment, two display areas are first taken as examples for illustration.

In the present embodiment, the scanning direction of the first display area 101 is the same as the first direction X, the scanning direction of the second display area 102 is opposite to the first direction X, and the first direction X is parallel to the data line of the display panel 100. The scanning direction of the present application can be understood as the order in which the scanning lines receive the scanning signals. For example, in FIG. 2, the scanning lines in the first display area 101 sequentially receive the corresponding scanning signals from left to right, and the scanning lines in the second display area 102 sequentially receive corresponding scanning signals from right to left. In addition, in FIGS. 1 to 5, the vertical lines located in the display panel 100 are scanning lines of the present application.

In the present embodiment, the display panel 100 may include 2k scanning lines. The $1^{st}$ to $k^{th}$ scanning lines are located in the first display area 101, and the $(k+1)^{th}$ to $(2k)^{th}$ scanning lines are located in the second display area 102.

The scanning direction of the first display area 101 is the $1^{st}$ to $k^{th}$ scanning lines, and the scanning direction of the second display area 102 is the $(2k)^{th}$ to $(k+1)^{th}$ scanning lines, wherein the k is a positive integer.

In the present embodiment, the driving chip 30 includes 2k output channels, and one of the output channels is correspondingly connected to one of the scanning lines. The output channel in a first driving area 30 in the driving chip 30 is correspondingly connected to the scanning line in the first display area 101, and the output channel in a second driving area 302 in the driving chip 30 is correspondingly connected to the scanning line in the second display area 102.

In the present embodiment, one of the output channels corresponds to one of output terminals 303 in the driving chip 30.

In the present embodiment, the first driving area 301 is the $1^{st}$ to $(2k-1)^{th}$ output channels which are the odd-numbered items in the driving chip 30, and the second driving area 302 is the $2^{nd}$ to $(2k)^{th}$ output channels which are the even-numbered items in the driving chip 30.

The $1^{st}$ to $k^{th}$ scanning lines in the first display area 101 are sequentially connected to the $1^{st}$ to $(2k-1)^{th}$ output channels in the first driving area 301, and the $(2k)^{th}$ to $(k+1)^{th}$ scanning lines in the second display area 102 are sequentially connected to the $2^{nd}$ to $(2k)^{th}$ output channels in the second driving area 302.

Please refer to FIG. 1, in the first display area 101 of the display panel 100, the first scanning line in the first display area 101 corresponds to the first output channel of the driving chip 30, the second scanning line in the first display area 101 corresponds to the third output channel of the driving chip 30, and the third scanning line in the first display area 101 corresponds to the fifth output channel of the driving chip 30. According to the related connection relationship, the $k^{th}$ scanning line in the first display area 101 corresponds to the $(2k-1)^{th}$ output channel of the driving chip 30.

Similarly, in the second display area 102 of the display panel 100, the $(2k)^{th}$ scanning line in the second display area 102 corresponds to the second output channel of the driving chip 30, the $(2k-1)^{th}$ scanning line in the second display area 102 corresponds to the fourth output channel of the driving chip 30, and the $(2k-2)^{th}$ scanning line in the second display area 102 corresponds to the sixth output channel of the driving chip 30. According to the related connection relationship, the $(k+1)^{th}$ scanning line in the second display area 102 corresponds to the $(2k)^{th}$ output channel of the driving chip 30. The $(k+1)^{th}$ scanning line of the second display area 102 corresponds to the first scanning line of the second display area 102, and the $(2k)^{th}$ scanning line of the second display area 102 corresponds to the last one scanning line of the second display area 102.

In the present embodiment, the $(2k-1)^{th}$ and $(2k)^{th}$ output channels simultaneously input driving signals to the corresponding scanning lines.

It can be known from the connection relationship between the driving chip 30 and the scanning lines of the display panel 100 that the $1^{st}$ to the $(2k)^{th}$ output channels of the driving chip 30 sequentially receive scanning signals and input the scanning signals to the corresponding scanning lines. Therefore, the first scanning line of the first display area 101 and the $(2k)^{th}$ scanning line of the second display area 102 receive the scanning signals first, followed by the second scanning line of the first display area 101 and the $(2k-1)^{th}$ scanning line of the second display area 102 and so on. Accordingly, the scanning direction of the first display area 101 and the scanning direction of the second display area 102 are toward each other or away from each other.

According to the above scanning method, the sub-pixels connected to the first scanning line of the first display area 101 and the $(2k)^{th}$ scanning line of the second display area 102 have the maximum brightness, and the sub-pixels connected to the $k^{th}$ scanning line of the first display area 101 and the $(k+1)^{th}$ scanning line of the second display area 102 have the minimum brightness. Therefore, when the display panel 100 receives the same gray-scale voltage, the minimum brightness area of the display panel 100 is located between the first display area 101 and the second display area 102. The brightness of the first display area 101 and the second display area 102 of the present application is theoretically gradually decreased first and then gradually increased, while the area between the two adjacent display areas has the minimum or maximum brightness. The above changes of the brightness are invisible to human eyes, and can only be detected by accurate brightness measuring instruments.

In addition, when the scanning directions of the first display area 101 and the second display area 102 are away from each other, and the display panel 100 receives the same gray-scale voltage, the maximum brightness area of the display panel 100 is located between the first display area 101 and the second display area 102.

According to the technical solutions disclosed in the above embodiments, the display panel 100 in the present application is driven by partitions to display, and the number of the scanning lines in each partition is equal. Compared with the prior art, by doubling the charging time of the thin film transistor in the sub-pixel corresponding to each scanning line in the time of one frame, more scanning lines of the display panel 100 of the present application can be disposed, the size of the product can be expanded, and the refresh rate of the product can be increased, so as to improve the display effect of the panel.

Figure 2:
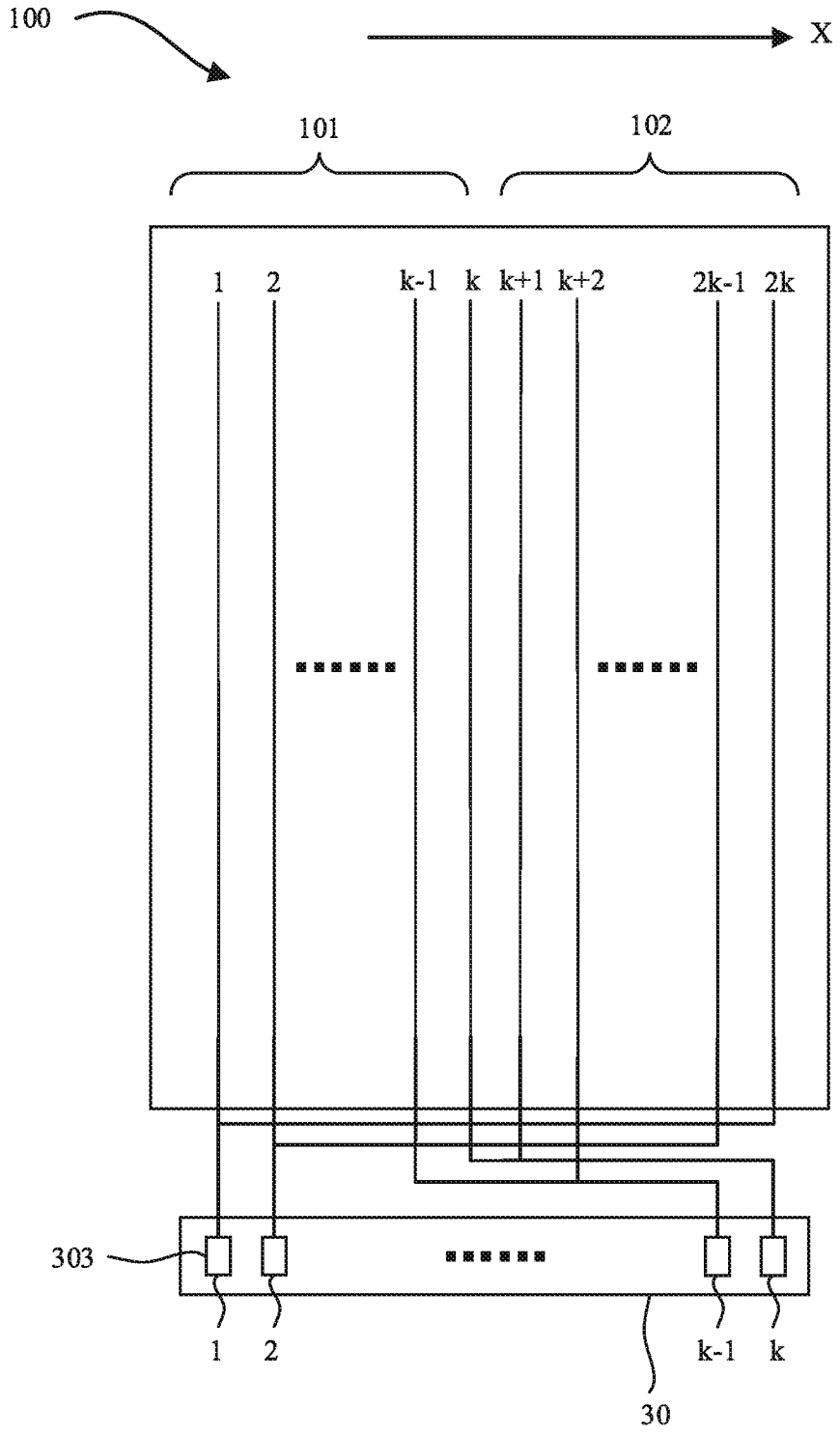
FIG. 2 is a second structural diagram of a display device of this application.

Refer to FIG. 2. The driving chip 30 includes k output terminals 303. One of the output terminals 303 includes two output channels.

In the present embodiment, the $(2k-1)^{th}$ output channel in the first driving area 301 and the $(2k)^{th}$ output channel in the second driving area 302 are electrically connected to the $k^{th}$ output terminal 303 in the driving chip 30.

Unlike the embodiment in FIG. 1, in the driving chip 30, the first scanning line of the first display area 101 and the $(2k)^{th}$ scanning line of the second display area 102 simultaneously receive the scanning signals output by the first output terminal 303 of the driving chip 30, and then the second scanning line of the first display area 101 and the $(2k-1)^{th}$ scanning line of the second display area 102 simultaneously receive the scanning signals output by the second output terminal 303 of the driving chip 30 and so on. In the present embodiment, there is no time delay for the scanning line in each display area that first receives the scanning signal. The scanning lines of the adjacent display areas simultaneously receive the corresponding scanning signals, so that the brightness of the area between the two adjacent display areas is uniform.

Figure 3:
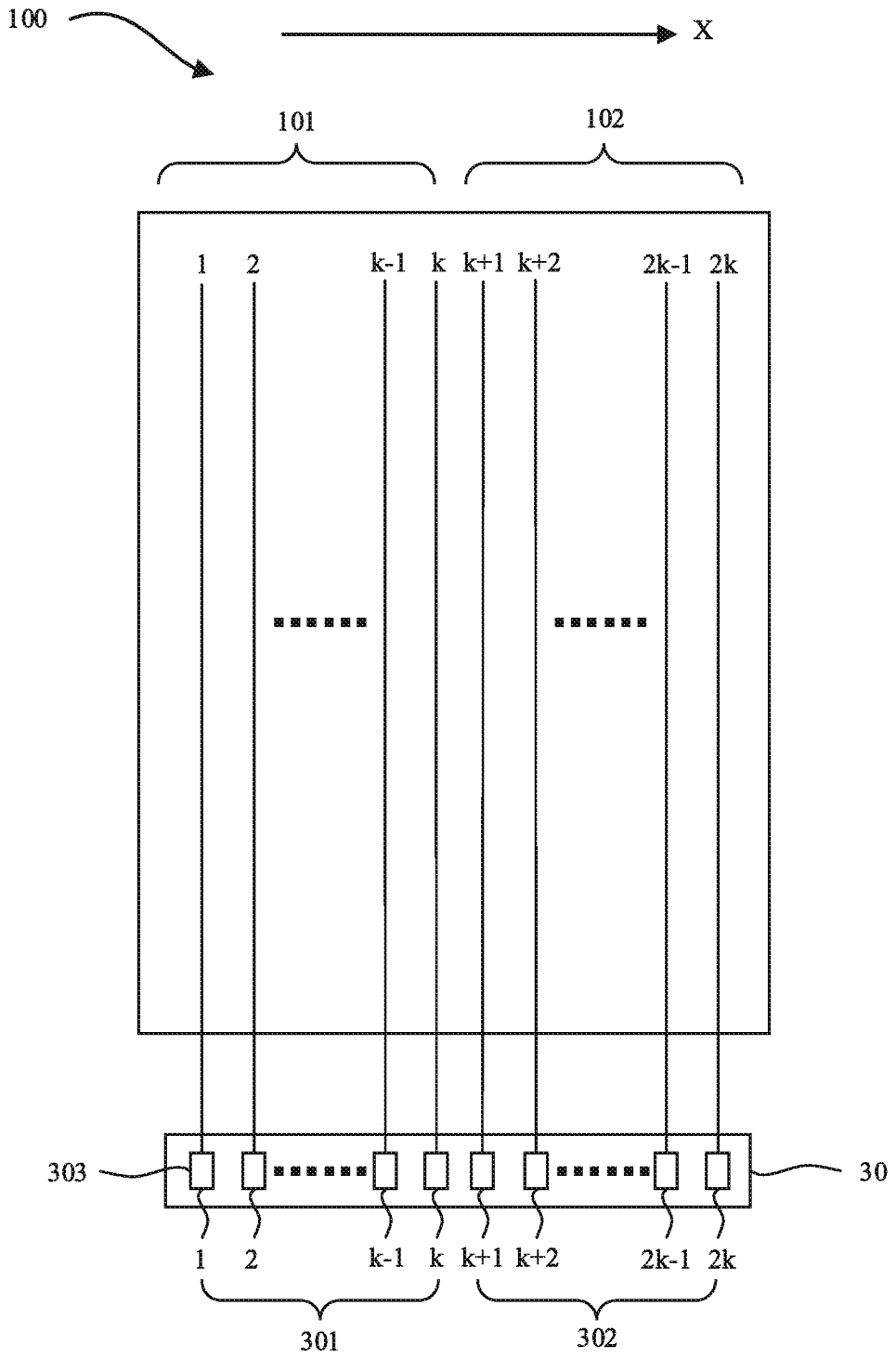
FIG. 3 is a third structural diagram of a display device of this application.

Please refer to FIG. 3, the first driving area 301 is the $1^{st}$ to $k^{th}$ output channels in the driving chip 30, and the second driving area 302 is the $(k+1)^{th}$ to $(2k)^{th}$ output channels in the driving chip 30.

The $1^{st}$ to $k^{th}$ scanning lines in the first display area 101 are electrically connected to the $1^{st}$ to $k^{th}$ output channels in the first driving area 301 in sequence, and the $(k+1)^{th}$ to $(2k)^{th}$ scanning lines in the second display area 102 are electrically connected to the $(k+1)^{th}$ to $(2k)^{th}$ output channels in the second driving area 302 in sequence.

In the present embodiment, the display device outputs a first scanning signal to the $1^{st}$ to $k^{th}$ output channels, and simultaneously outputs a second scanning signal to the $(2k)^{th}$ to $(k+1)^{th}$ output channels.

In the present embodiment, the $n^{th}$ scanning line of the first display area 101 and the $(2k+1-n)^{th}$ scanning line of the second display area 102 simultaneously receive the scanning signals input by the corresponding output channel, $1 \le n \le k$, and n is a positive integer.

For example, the display panel 100 outputs a first scanning signal to the $1^{st}$ to $k^{th}$ output channels in the first driving area 301, and simultaneously outputs a second scanning signal to the $(2k)^{th}$ to $(k+1)^{th}$ output channels in the second driving area 302. The present application adjusts the order where the output channels in the second driving area 302 receive scanning signals. For example, the output terminal 303 in the first driving area 301 receives the corresponding first scanning signals from left to right, and the output terminal 303 receives the corresponding second scanning signals from right to left. Thus, the first scanning line of the first display area 101 receives the first scanning signal output by the first output terminal 303 in the first driving area 301, while the $(2k)^{th}$ scanning line of the second display area 102 receives the second scanning signal output by the $(2k)^{th}$ output terminal 303 of the second driving area 302, and the second scanning line of the first display area 101 receives the first scanning signal output by the second output terminal 303 in the first driving area 301, while the $(2k-1)^{th}$ scanning line of the second display area 102 receives the second scanning signal output by the $(2k-1)^{th}$ output terminal 303 of the second driving area 302 and so on. The first display area 101 and the second display area 102 can scan toward each other by the above technical solution.

In the present embodiment, the first driving area 301 and the second driving area 302 are controlled individually. The first driving area 301 includes a first input terminal, and the second driving area 302 includes a second input terminal. When the first display area 101 and the second display area 102 scan toward each other, the first input terminal and the second input terminal are located on both sides of the driving chip 30, so that the scanning signals received by the first driving area 301 and the second driving area 302 are converged from both sides to the middle. When the first display area 101 and the second display area 102 scan away from each other, the first input terminal and the second input terminal are located in the middle of the driving chip 30, so that the signals received by the first driving area 301 and the second driving area 302 diffuse from the middle to both sides of the driving chip 30.

Figure 4:
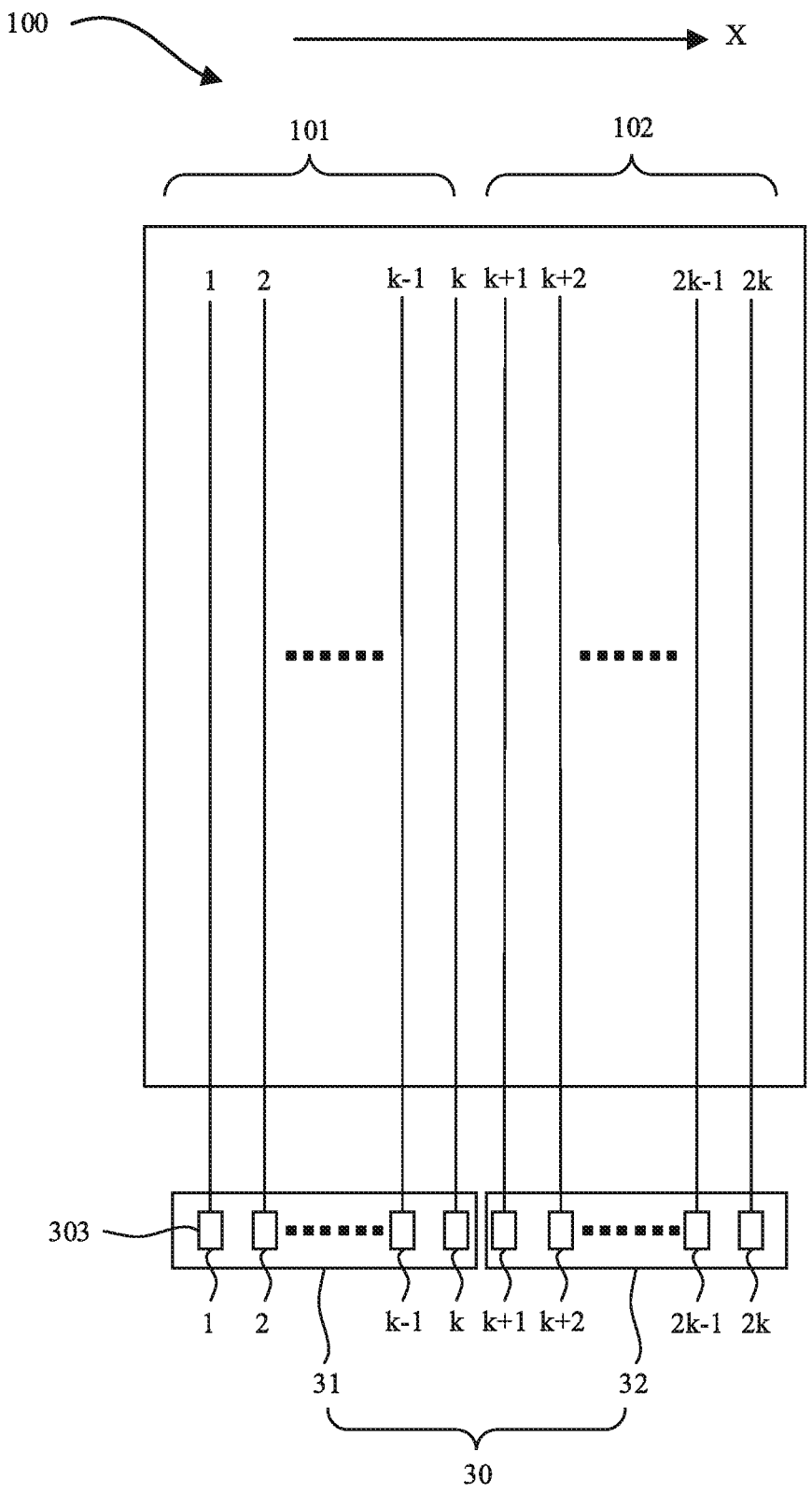
FIG. 4 is a fourth structural diagram of a display device of this application.

Refer to FIG. 4, the driving chip 30 includes at least a first driver 31 and a second driver 32. The first driver 31 is used to drive the first display area 101 to display, and the second driver 32 is used to drive the second display area 102 to display.

The first driver 31 includes k first output channels arranged along the first direction X, and the second display area 102 includes k second output channels arranged along the second direction. One of the scanning lines is correspondingly connected to one of the first output channels or one of the second output channels.

The $1^{st}$ to $k^{th}$ scanning lines in the first display area 101 are electrically connected to the $1^{st}$ to $k^{th}$ first output channels in the first driver 31 in sequence, and the $(2k)^{th}$ to $(k+1)^{th}$ scanning lines in the second display area 102 are electrically connected to the $1^{st}$ to $k^{th}$ second output channels in the second driver 32 in sequence. In the present embodiment, the connection method between any driver and the scanning line in the display area is not limited to the above methods.

In the present embodiment, the $n^{th}$ scanning line of the first display area 101 and the $(2k+1-n)^{th}$ scanning line of the second display area 102 simultaneously receive the scanning signals input by the corresponding output channels, $1 \leq n \leq k$, and n is a positive integer.

In the present embodiment, one display panel 100 may be driven by two drivers, and one driver corresponds to one display area. When the display panel 100 has multiple display areas, the driving chip 30 may also be driven by multiple drivers, which is not specifically limited in the present application.

Figure 5:
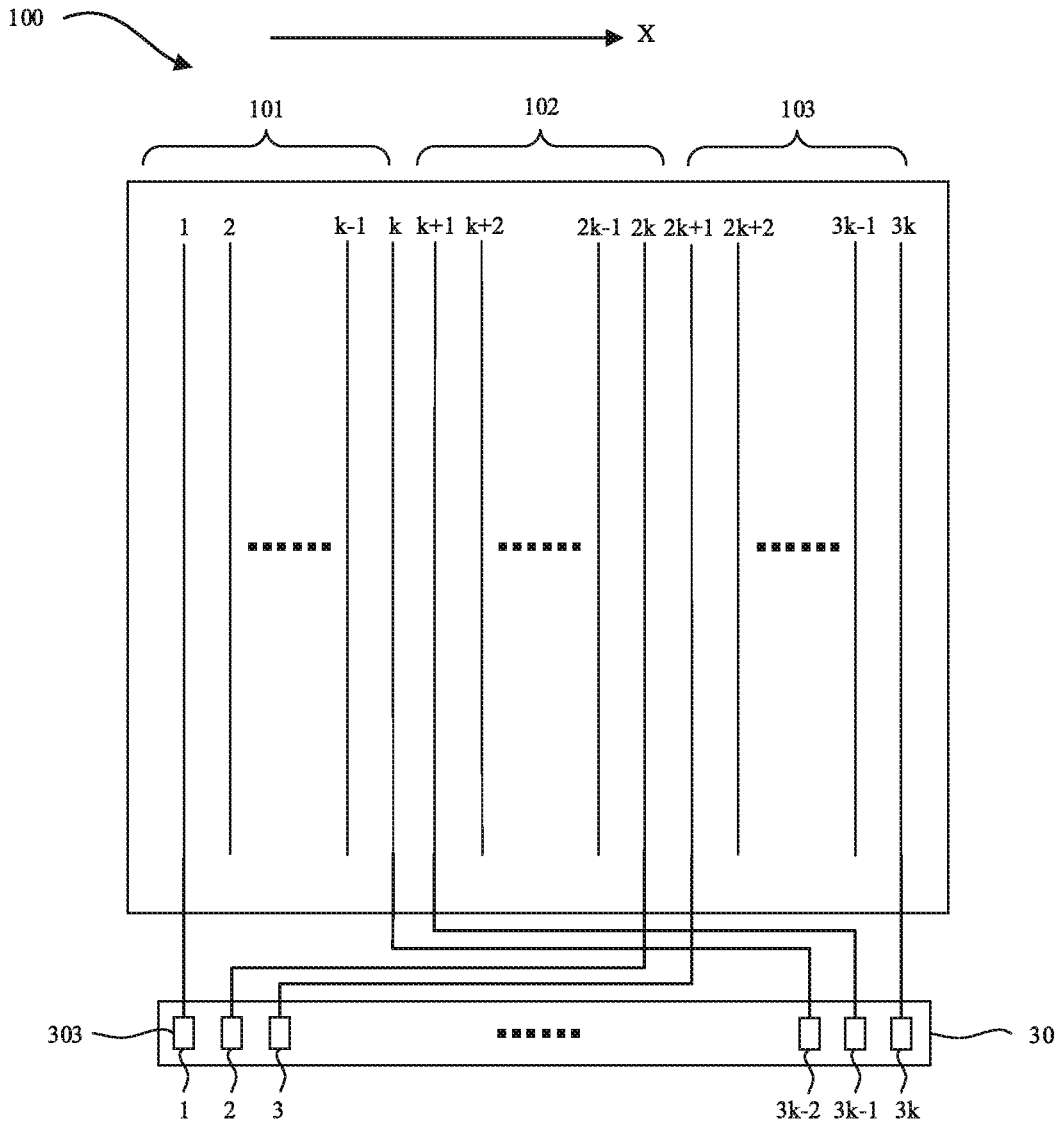
FIG. 5 is a fifth structural diagram of a display device of the present application.

Refer to FIG. 5. The display panel 100 further includes a third display area 103 located on one side of the second display area 102 and away from the first display area 101. A scanning direction of the third display area 103 is the same as the scanning direction of the first display area 101.

In the present embodiment, the display panel 100 may include a plurality of display areas, and three display areas are taken as an example for illustration here.

Refer to FIG. 5. The display panel 100 may include 3k scanning lines. The $1^{st}$ to $k^{th}$ scanning lines are located in the first display area 101, the $(k+1)^{th}$ to $(2k)^{th}$ scanning lines are located in the second display area 102, and the $(2k+1)^{th}$ to $(3k)^{th}$ scanning lines are located in the third display area 103.

The scanning direction of the first display area 101 is the $1^{st}$ to $k^{th}$ scanning lines, the scanning direction of the second display area 102 is the $(2^{k})^{th}$ to $(k+1)^{th}$ scanning lines, and the scanning direction of the third display area 103 is the $(2k+1)^{th}$ to $(3k)^{th}$ scanning line.

In the present embodiment, the driving chip 30 includes 3k output channels, and one of the output channels is correspondingly connected to one of the scanning lines. The output channel in the first driving area 301 in the driving chip 30 is correspondingly connected to the scanning line in the first display area 101, the output channel in the second driving area 302 in the driving chip 30 is correspondingly connected to the scanning line in the second display area 102, and the output channel in the third driving area in the driving chip 30 is correspondingly connected to the scanning line in the third display area 103. One of the output channels corresponds to one of the output terminals 303 in the driving chip 30.

In the present embodiment, the first driving area 301 is the k output channels, from $1^{st}$ to $(3k-2)^{th}$ in the driving chip 30. The second driving area 302 is the k output channels, from $2^{nd}$ to $(3k-1)^{th}$ in the driving chip 30. The third driving area is the k output channels, from $3^{rd}$ to $(3k)^{th}$ in the driving chip 30.

The $1^{st}$ to $k^{th}$ scanning lines in the first display area 101 are sequentially connected to the $1^{st}$ to $(3k-2)^{th}$ output channels in the first driving area 301, the $(2k)^{th}$ to $(k+1)^{th}$ scanning lines in the second display area 102 are sequentially connected to the $2^{nd}$ to $(3k-1)^{th}$ output channels in the second driving area 302, and the $(2k+1)^{th}$ to $(3k)^{th}$ scanning lines in the third display area 103 are sequentially connected to the $3^{rd}$ to $(3k)^{th}$ output channels in the second driving area 302.

Refer to FIG. 5. In the first display area 101 of the display panel 100, the first scanning line in the first display area 101 corresponds to the first output channel of the driving chip 30, the second scanning line in the first display area 101 corresponds to the fourth output channel of the driving chip 30, and the third scanning line in the first display area 101 corresponds to the seventh output channel of the driving chip 30. According to the related connection relationship, the $k^{th}$ scanning line in the first display area 101 corresponds to the $(3k-2)^{th}$ output channel of the driving chip 30.

Similarly, in the second display area 102 of the display panel 100, the $(2k)^{th}$ scanning line in the second display area 102 corresponds to the second output channel of the driving chip 30, the $(2k-1)^{th}$ scanning line in the second display area 102 corresponds to the fifth output channel of the driving chip 30, and the $(2k-2)^{th}$ scanning line in the second display area 102 corresponds to the eighth output channel of the driving chip 30. According to the related connection relationship, the $(k+1)^{th}$ scanning line in the second display area 102 corresponds to the $(3k-1)^{th}$ output channel of the driving chip 30.

Similarly, in the third display area 103 of the display panel 100, the $(2k+1)^{th}$ scanning line in the third display area 103 corresponds to the third output channel of the driving chip 30, the $(2k+2)^{th}$ scanning line in the third display area 103 corresponds to the sixth output channel of the driving chip 30, and the $(2k+3)^{th}$ scanning line in the third display area 103 corresponds to the ninth output channel of the driving chip 30. According to the related connection relationship, the $(3k)^{th}$ scanning line in the second display area 102 corresponds to the $(3k)^{th}$ output channel of the driving chip 30.

It can be known from the connection relationship between the driving chip 30 and the scanning lines of the display panel 100 that the first to the $(3k)^{th}$ output channels of the driving chip 30 sequentially receive scanning signals and input the scanning signals to the corresponding scanning lines. Therefore, the first scanning line of the first display area 101, the $(2k)^{th}$ scanning line of the second display area 102, and the $(2k+1)^{th}$ scanning line of the third display area 103 receive the scanning signals first, followed by the second scanning line of the first display area 101, the $(2k-1)^{th}$ scanning line of the second display area 102, and the $(2k+2)^{th}$ scanning line of the third display area 103 and so on. Accordingly, the scanning direction of the first display area 101 and the scanning direction of the second display area 102 are toward each other, and the scanning direction of the second display area 102 and the scanning direction of the third display area 103 are away from each other.

According to the above scanning method, the sub-pixels connected to the first scanning line of the first display area 101, the $(2k)^{th}$ scanning line of the second display area 102, and the $(2k+1)^{th}$ scanning line of the third display area 103 have the maximum brightness, and the sub-pixels connected to the $k^{th}$ scanning line of the first display area 101, the $(k+1)^{th}$ scanning line of the second display area 102, and the $(3k)^{th}$ scanning line of the third display area 103 have the minimum brightness. Therefore, when the display panel 100 receives the same gray-scale voltage, the minimum brightness area of the display panel 100 is located between the first display area 101 and the second display area 102, and the maximum brightness area of the display panel 100 is located between the third display area 103 and the second display area 102.

The brightness of the first display area 101, the second display area 102 and the third display area 103 of the present application is theoretically gradually decreased first, then gradually increased, and finally gradually decreased, while the area between the two adjacent display areas has the minimum or maximum brightness. The above changes of the brightness are invisible to human eyes, and can only be detected by accurate brightness measuring instruments. The present application improves the brightness uniformity of the display panel by driving the display panel by partitions.

According to the technical solution disclosed in FIG. 5, in the present application, by driving the display panel 100 by partitions to display, the number of the scanning lines of each partition is changed to one-third of the original. Compared with the prior art, the charging time of the thin film transistor in the sub-pixel corresponding to each scanning line is increased by three times in the time of one frame, so that more scanning lines of the display panel 100 of the present application is disposed, the size of the product is expanded, and the refresh rate of the product is increased, so as to improve the display effect of the panel.

The present application proposes a display device including a display panel and a driving chip. The display panel includes at least a first display area and a second display area arranged in parallel along a first direction. The driving chip is used to drive the display area to display, and to control the first display area and the second display area to scan toward each other or to scan away from each other. In the present application, by controlling any two adjacent display areas to scan toward each other or to scan away from each other, at least one scanning line in the first display area and at least one scanning line in the second display area simultaneously receive driving signals input from the driving chip, thereby improving the uniformity of the display panel. In addition, the plurality of display areas scanning at the same time increases the charging time of any scanning lines, so that the size and the resolution of the display device can be improved.

It should be understood by those ordinary skilled in the art that equivalent replacements or changes can be made according to the technical solutions and inventive concepts of the present application, and all such changes or replacements should fall within the protection scope of the claims appended to the present application.

What is claimed is:

1. A display device, comprising: a display panel and a driving chip, the display panel including at least a first display area and a second display area arranged side by side along a first direction, the driving chip being configured to drive the first display area and the second display area to display, and to control the first display area and the second display area to scan toward each other or to scan away from each other;

wherein, at least one scanning line in the first display area and at least one scanning line in the second display area simultaneously receive driving signals input from the driving chip;

wherein a scanning direction of the first display area is the same as the first direction, and a scanning direction of the second display area is opposite to the first direction;

wherein the display panel includes 2 k scanning lines, the $1^{st}$ to $k^{th}$ scanning lines are located in the first display area, and the (k+1)th to (2k)th scanning lines are located in the second display area; and the scanning direction of the first display area is the $1^{st}$ to $k^{th}$ scanning lines, and the scanning direction of the second display area is the (2k)th to $(k+1)^{th}$ scanning lines, wherein the k is a positive integer.

2. The display device of claim 1, wherein the driving chip includes 2k output channels, and one of the output channels is correspondingly connected to one of the scanning lines;

wherein the output channel in a first driving area in the driving chip is correspondingly connected to the scanning line in the first display area, and the output channel in a second driving area in the driving chip is correspondingly connected to the scanning line in the second display area.

3. The display device of claim 2, wherein the first driving area is the $1^{st}$ to $(2k-1)^{th}$ output channels which are the odd-numbered items in the driving chip, and the second driving area is the $2^{nd}$ to tar output channels which are the even-numbered items in the driving chip; and the $1^{st}$ to $k^{th}$ scanning lines in the first display area are sequentially connected to the $1^{st}$ to $(2k-1)^{th}$ output channels in the first driving area, and the $(2k)^{th}$ to $(k+1)^{th}$ scanning lines in the second display area are sequentially connected to the $2^{nd}$ to $(2k)^{th}$ output channels in the second driving area;

wherein the (2k−1)th and (2k)th output channels simultaneously input driving signals to the corresponding scanning lines.

4. The display device of claim 3, wherein the driving chip includes k output terminals, and one of the output terminals includes two of the output channels;

wherein the $(2k-1)^{th}$ output channel in the first driving area and the $(2k)^{th}$ output channel in the second driving area are electrically connected to the kth output terminal in the driving chip.

5. The display device of claim 2, wherein the first driving area is the 1st to kth output channels in the driving chip, and the second driving area is the $(k+1)^{th}$ to the $(2k)^{th}$ output channels in the driving chip;

the $1^{st}$ to $k^{th}$ scanning lines in the first display area are electrically connected to the $1^{st}$ to $k^{th}$ output channels in the first driving area in sequence, and the (k+1)th to $(2k)^{th}$ scanning lines in the second display area are electrically connected to the $(k+1)^{th}$ to (2k)th output channels in the second driving area in sequence; and the display device outputs a first scanning signal to the $1^{st}$ to $k^{th}$ output channels, and simultaneously outputs a second scanning signal to the (2k)th to $(k+1)^{th}$ output channels.

6. The display device of claim 1, wherein the driving chip includes at least a first driver and a second driver, the first driver is configured to drive the first display area to display, and the second driver is configured to drive the second display area to display;

wherein the first driver includes k first output channels arranged along a first direction, the second display area includes k second output channels arranged along a second direction, and one of the scanning lines is correspondingly connected to one of the first output channels or one of the second output channels;

wherein the $1^{st}$ to $k^{th}$ scanning lines in the first display area are electrically connected to the $1^{st}$ to $k^{th}$ first output channels in the first driver in sequence, and the $(2k)^{th}$ to (k+1)th scanning lines in the second display area are electrically connected to the $1^{st}$ to $k^{th}$ second output channels in the second driver in sequence.

7. The display device of claim 6, wherein the $n^{th}$ scanning line in the first display area and the $(2k+1-n)^{th}$ scanning line in the second display area simultaneously receive scanning signals input from the corresponding output channels, $1 \le n \le k$, and n is a positive integer.

8. The display device of claim 1, wherein the display panel further includes a third display area located on one side of the second display area and away from the first display area;

wherein a scanning direction of the third display area is the same as the scanning direction of the first display area.

9. A display device, comprising: a display panel and a driving chip, the display panel including at least a first display area and a second display area arranged side by side along a first direction, the driving chip being configured to drive the first display area and the second display area to display, and to control the first display area and the second display area to scan toward each other or to scan away from each other, wherein the first direction is parallel to a data line of the display panel;

wherein, at least one scanning line in the first display area and at least one scanning line in the second display area simultaneously receive driving signals input from the driving chip;

wherein a scanning direction of the first display area is the same as the first direction, and a scanning direction of the second display area is opposite to the first direction;

wherein the display panel includes 2k scanning lines, the $1^{st}$ to $k^{th}$ scanning lines are located in the first display area, and the (k+1)th to $(2k)^{th}$ scanning lines are located in the second display area; and the scanning direction of the first display area is the $1^{st}$ to $k^{th}$ scanning lines, and the scanning direction of the second display area is the $(2k)^{th}$ to $(k+1)^{th}$ scanning lines, wherein the k is a positive integer.

10. The display device of claim 9, wherein the driving chip includes 2k output channels, and one of the output channels is correspondingly connected to one of the scanning lines;

wherein the output channel in a first driving area in the driving chip is correspondingly connected to the scanning line in the first display area, and the output channel in a second driving area in the driving chip is correspondingly connected to the scanning line in the second display area.

11. The display device of claim 10, wherein the first driving area is the $1^{st}$ to (2k−1)th output channels which are the odd-numbered items in the driving chip, and the second driving area is the $2^{nd}$ to (2k)th output channels which are the even-numbered items in the driving chip; and the $1^{st}$ to $k^{th}$ scanning lines in the first display area are sequentially connected to the $1^{st}$ to $(2k-1)^{th}$ output channels in the first driving area, and the $(2k)^{th}$ to $(k+1)^{th}$ scanning lines in the second display area are sequentially connected to the $2^{nd}$ to $(2k)^{th}$ output channels in the second driving area;

wherein the $(2k-1)^{th}$ and (2k)th output channels simultaneously input driving signals to the corresponding scanning lines.

12. The display device of claim 11, wherein the driving chip includes k output terminals, and one of the output terminals includes two of the output channels;

wherein the $(2k-1)^{th}$ output channel in the first driving area and the $(2k)^{th}$ output channel in the second driving area are electrically connected to the kth output terminal in the driving chip.

13. The display device of claim 10, wherein the first driving area is the $1^{st}$ to $k^{th}$ output channels in the driving chip, and the second driving area is the $(k+1)^{th}$ to the $(2k)^{th}$ output channels in the driving chip;

the $1^{st}$ to kth scanning lines in the first display area are electrically connected to the $1^{st}$ to $k^{th}$ output channels in the first driving area in sequence, and the $(k+1)^{th}$ to $(2k)^{th}$ scanning lines in the second display area are electrically connected to the $(k+1)^{th}$ to (2k)th output channels in the second driving area in sequence; and the display device outputs a first scanning signal to the $1^{st}$ to $k^{th}$ output channels, and simultaneously outputs a second scanning signal to the $(2k)^{th}$ to $(k+1)^{th}$ output channels.

14. The display device of claim 9, wherein the driving chip includes at least a first driver and a second driver, the first driver is configured to drive the first display area to display, and the second driver is configured to drive the second display area to display;

wherein the first driver includes k first output channels arranged along a first direction, the second display area includes k second output channels arranged along a second direction, and one of the scanning lines is correspondingly connected to one of the first output channels or one of the second output channels;

wherein the $1^{st}$ to $k^{th}$ scanning lines in the first display area are electrically connected to the $1^{st}$ to $k^{th}$ first output channels in the first driver in sequence, and the $(2k)^{th}$ to $(k+1)^{th}$ scanning lines in the second display area are electrically connected to the $1^{st}$ to $k^{th}$ second output channels in the second driver in sequence.

15. The display device of claim 14, wherein the $n^{th}$ scanning line in the first display area and the $(2k+1-n)^{th}$ scanning line in the second display area simultaneously receive scanning signals input from the corresponding output channels, $1 \le n \le k$, and n is a positive integer.

16. The display device of claim 9, wherein the display panel further includes a third display area located on one side of the second display area and away from the first display area;

wherein a scanning direction of the third display area is the same as the scanning direction of the first display area.

* * * * *